United States Patent [19]

Synek

[11] 4,089,352

[45] May 16, 1978

[54] APPARATUS FOR POSITIVELY CONNECTING TWO OVERLAPPING BAND PORTIONS

[75] Inventor: Wenzel Synek, Oberengstringen, Switzerland

[73] Assignee: FROMM AG, Spreitenbach, Switzerland

[21] Appl. No.: 771,033

[22] Filed: Feb. 22, 1977

[51] Int. Cl.[2] ..... B21F 9/02

[52] U.S. Cl. ..... 140/93.2

[58] Field of Search ..... 100/29, 33 R; 140/93 A, 140/93.2, 93.4

[56] References Cited

U.S. PATENT DOCUMENTS

| | | | |
|---|---|---|---|
| 3,545,499 | 12/1970 | Dalton et al. | 140/93.2 |
| 3,794,086 | 2/1974 | Hall et al. | 140/93.2 |
| 3,804,001 | 4/1974 | Longerich et al. | 140/93.2 X |
| 3,811,481 | 5/1974 | Back | 140/93.2 |

*Primary Examiner*—E. M. Combs

*Attorney, Agent, or Firm*—Werner W. Kleeman

[57] ABSTRACT

An apparatus for the form-locking or positive connection of two overlapping band portions, comprising a first tool movably mounted in a housing and driven by means of a drive and a second tool arranged to rest upon a base plate member fixedly attached at one side with the housing. The base plate member is releasably connected with the housing by means of a counter-holder member at the side opposite the side where the base plate member is fixedly attached with the housing. The housing is hingedly connected either with the counter-holder member or the base plate member in such a manner that the counter-holder member and the base plate member can be brought into and out of engagement with one another.

6 Claims, 4 Drawing Figures

APPARATUS FOR POSITIVELY CONNECTING TWO OVERLAPPING BAND PORTIONS

BACKGROUND OF THE INVENTION

The present invention relates to a new and improved construction of apparatus for the form-locking or positive interconnection of two overlapping band portions or the like, which is of the type comprising a first tool movably mounted in a housing and driven by a drive and a second tool arranged to rest upon a base plate member which is rigidly connected at one side with the housing.

Equipment of this type is especially used for tying together various types of articles as well as for reinforcing boxes, crates, packages and the like for shipping purposes.

An apparatus of the previously mentioned type has been disclosed, by way of example, in Swiss Pat. No. 533,541. This apparatus is associated with the drawback that the base plate member, during the strapping operation, tends to undesirably bend-through, so that, on the one hand, the strapping operation is affected in a disadvantageous manner and, on the other hand, the apparatus can become damaged.

SUMMARY OF THE INVENTION

Hence, with the foregoing in mind it is a primary object of the present invention to provide a new and improved construction of apparatus for interconnecting two overlapping band portions in a manner not associated with the aforementioned drawbacks and limitations of the prior art proposals.

Still another important object of the present invention aims at the provision of a new and improved construction of strapping apparatus which is relatively simple in construction and design, economical to manufacture, and is constructed such that undesirable bending-through of the base plate member is effectively avoided or appreciably minimized, to thereby improve both the strapping operation and the functionality and longevity of the equipment.

Now in order to implement these and still further objects of the invention, which will become more readily apparent as the description proceeds, the apparatus of the invention is manifested by the features that the base plate member is releasably connected by means of a counter-holder member with the housing at the side opposite the side where the base plate member is fixedly or rigidly connected with the housing, and the housing is hingedly connected either with the counter-holder member or the base plate member in such a manner that the counter-holder member and the base plate member can be brought into and out of engagement with one another.

By virtue of the fact that the base plate member is also supported by means of the counter-holder member at the side opposite the attachment side, there is afforded a considerable reinforcement of the apparatus and undesirable bending-through of the base plate is avoided. Since the counter-holder member is releasably connected with the base plate member and the housing is either hingedly connected with the counter-holder member or the base plate member, the counter-holder member and the base plate member can be selectively brought into and out of engagement with one another, so that the band portions can be easily inserted and removed. Consequently, the apparatus is not only considerably more stable, but furthermore it is especially also possible to use a thinner base plate member, so that in particular when strapping articles and packages less play is required for the base plate member, with the result that there can be strapped strapping bands to which there is applied greater strapping tension.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
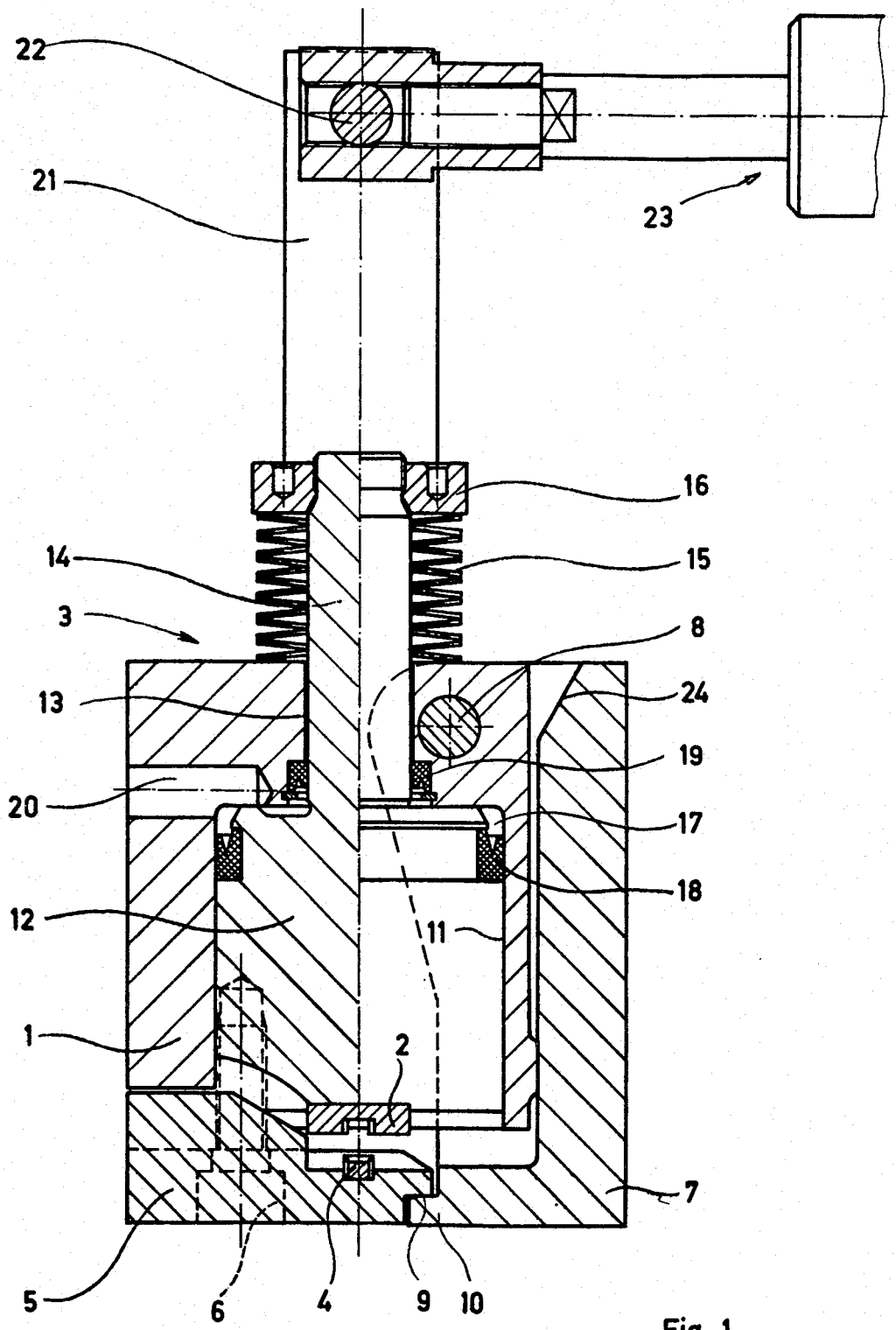
FIG. 1 is a vertical sectional view through a first embodiment of strapping apparatus, illustrating the same prior to the strapping operation, wherein the housing thereof is articulated with a counter-holder member.

Turning now to the drawings, it is to be understood that only enough of the structure of the strapping apparatus has been shown in the drawings to enable those skilled in the art to readily understand that underlying concepts and principles with which the invention is concerned. Hence, in FIGS. 1 to 3 there is illustrated a strapping apparatus for the form-locking or positive connection of overlapping portions of a band or strap, which has not been particularly shown since such structure is conventional, and which apparatus will be seen to comprise a housing 1 in which there is movably mounted a first tool 2. The tool 2 can be displaced by a suitable drive 3 to be discussed more fully hereinafter. Cooperating with the movable tool 2 is a second tool 4 which is stationarily arranged and attached to a base plate member 5. This base plate member 5 is fixedly or rigidly connected with the housing 1 at one side thereof by means of the screws 6 or equivalent fastening expedients. At the side of the base plate member 5 which is located opposite the side where it is attached to the housing 1 this base plate member 5 releasably cooperates in a form-locking manner with a counter-holder member 7. This counter-holder member 7 is hingedly connected or articulated by means of a hinge or pivot joint 8 with the housing 1 of the apparatus. The base plate member 5 contains a recess 9 intended to cooperate with the counter-holder member 7. Extending into this recess 9 is a nose 10 of the counter-holder member 7 which absorbs part of the pressure force which is applied when the tools 2 and 4 coact with one another during performance of the strapping operation.

As to the drive 3 of the apparatus the same will be seen to comprise a piston 12 which is reciprocally arranged in a cylinder 11 of the housing 1. Piston 12 is connected with a piston rod 14 extending upwardly out of the housing 1 through an opening or bore 13 of such housing. This piston rod 14 will be seen to support a package of plate springs 15 at a location externally of the housing 1, the spring package being biased by means of a nut member 16 against the housing 1 and retaining the piston 12 in its upper starting position. This piston 12 forms at its upper end a work chamber or compartment 17 within the cylinder 11. Work chamber 17 is sealed towards the bottom at the piston 12 by means of a seal 18 and towards the top at the piston rod 14 by means of a seal 19. An infeed channel 20 serves for the supply of a working fluid medium into the work chamber 17 of the piston-cylinder unit 11, 12. This work fluid medium or working fluid can be, for instance, compressed air or hydraulic oil.

Continuing, the apparatus will be seen to further comprise an arm 21 which is connected by means of a hinge or pivot joint 22 with a piston-cylinder unit 23. The arm 21, when operated by the piston-cylinder unit 23, serves to pivot-out or extend the housing 1 about the hinge or pivot joint 8, as best seen by referring to FIG. 3. A stop or contact surface 24 arranged at the counter-holder member 7 limits the outward rocking or pivotal movement of the housing 1.

Having now had the benefit of the foregoing discussion of the structure of the exemplary embodiment of apparatus shown in FIGS. 1 to 3, its mode of operation will be described and is as follows:

In the starting position of the equipment, illustrated in FIG. 1, band or strap portions are displaced from opposite sides of the apparatus through the gap formed between the tools 2 and 4 and tensioned. Thereafter, by means of the infeed or delivery channel 20 the work fluid medium is delivered into the work chamber 17 of the piston-cylinder unit 11, 12 and the piston 12 is moved downwardly against the pre-biasing force of the package of plate springs 15, so that the tools 2 and 4 deform and interconnect in conventional manner the portions of the band or strap of a metal band located between the tools 2 and 4. By relieving the work fluid medium by means of the infeed channel 20, for instance venting it to the atmosphere or delivering it to a collecting container or reservoir, the piston 12 is again relieved of the fluid load and can return, under the action of the plate springs 15, back into its starting position. By means of the piston-cylinder unit 23 the apparatus can be opened in that the housing 1 is rocked about the hinge or pivot joint 8 until it bears against the contact or stop surface 24. As a result, the interconnected band portions slide off of the lower tool 4 and the base plate or base plate member 5 and the apparatus can be removed.

Figure 2:
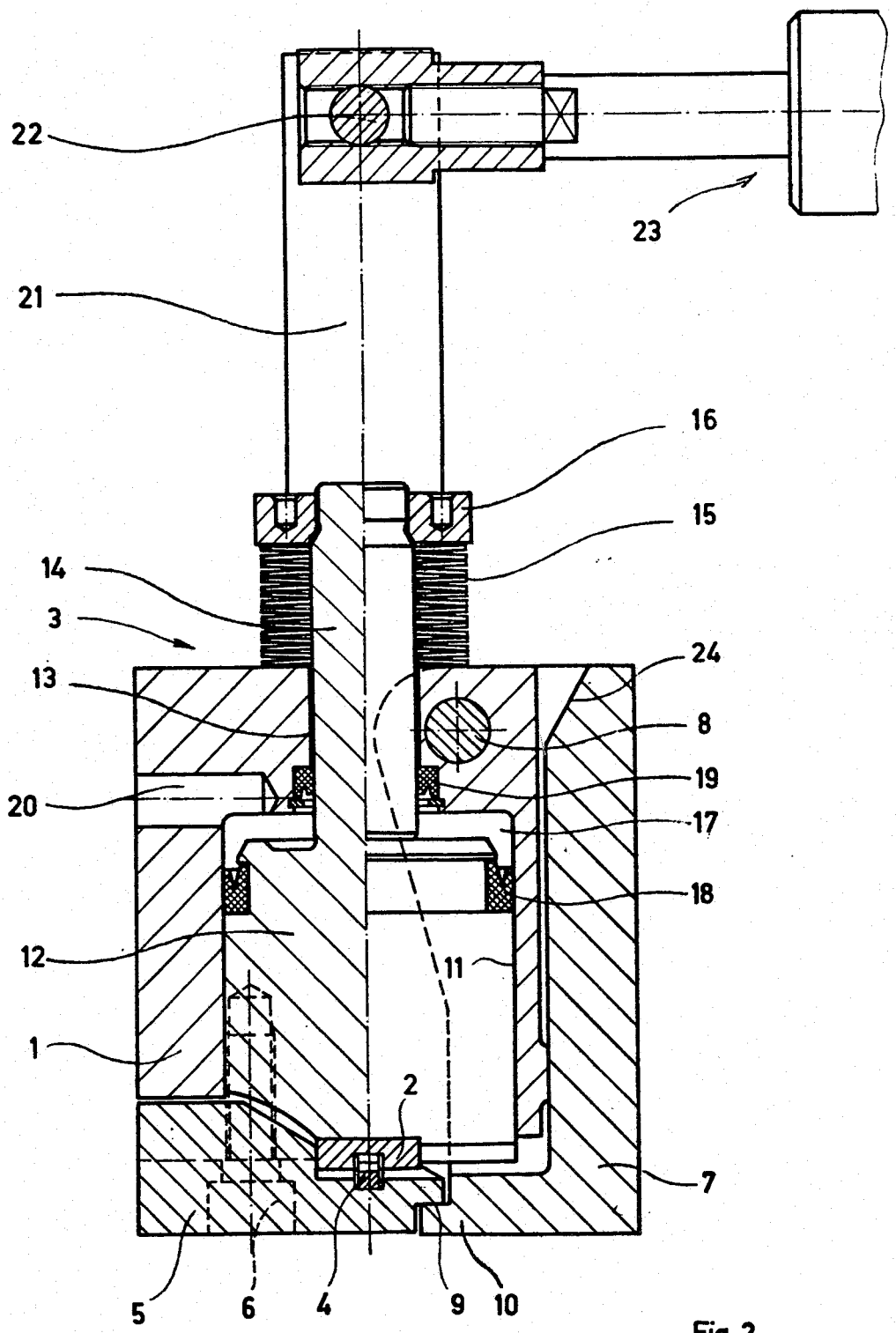
FIG. 2 illustrates the apparatus of FIG. 1 during the strapping or connection operation.
Figure 3:
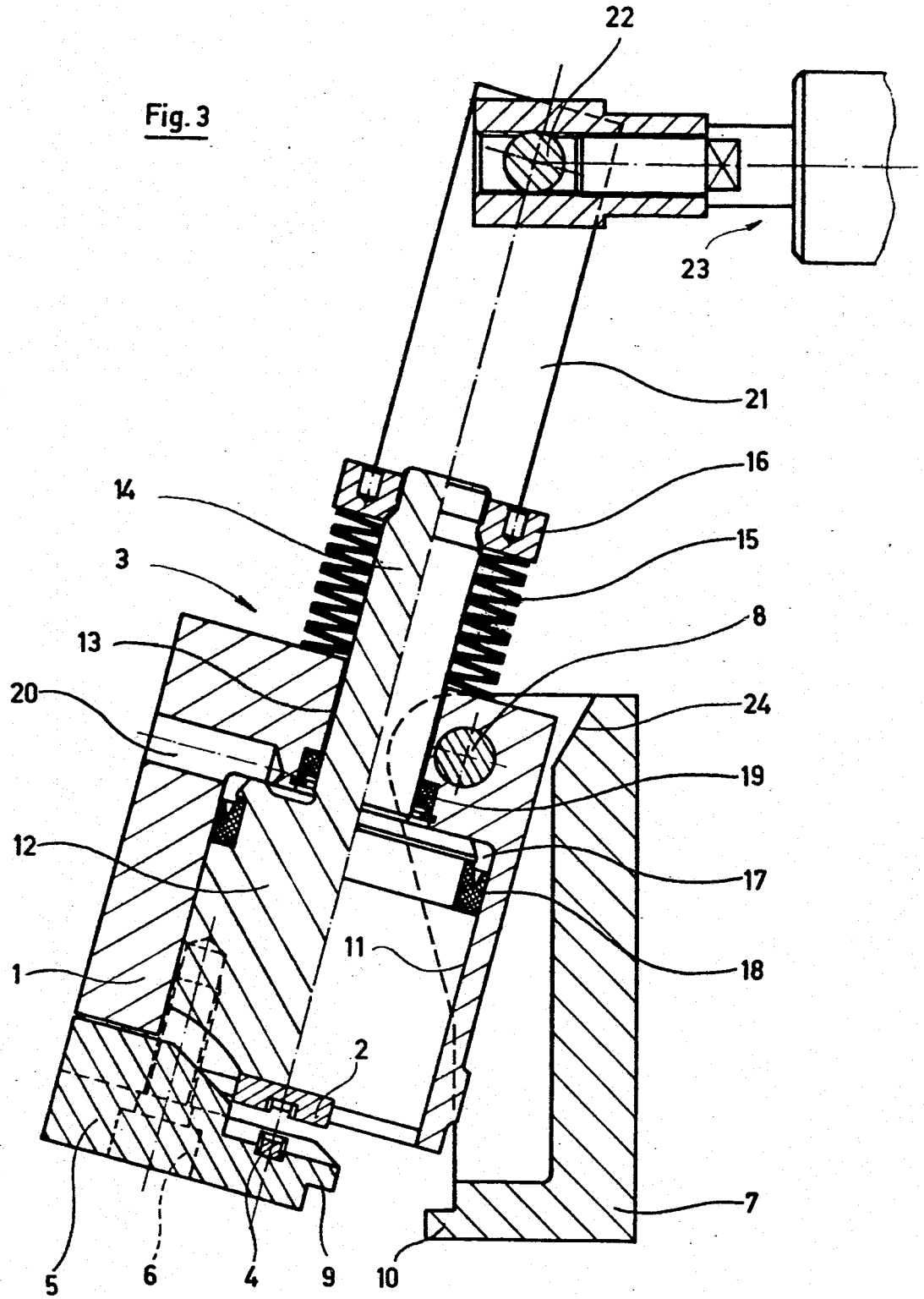
FIG. 3 illustrates the apparatus of FIG. 1 in a position wherein the counter-holder member and the base plate member are no longer in engagement with one another.
Figure 4:
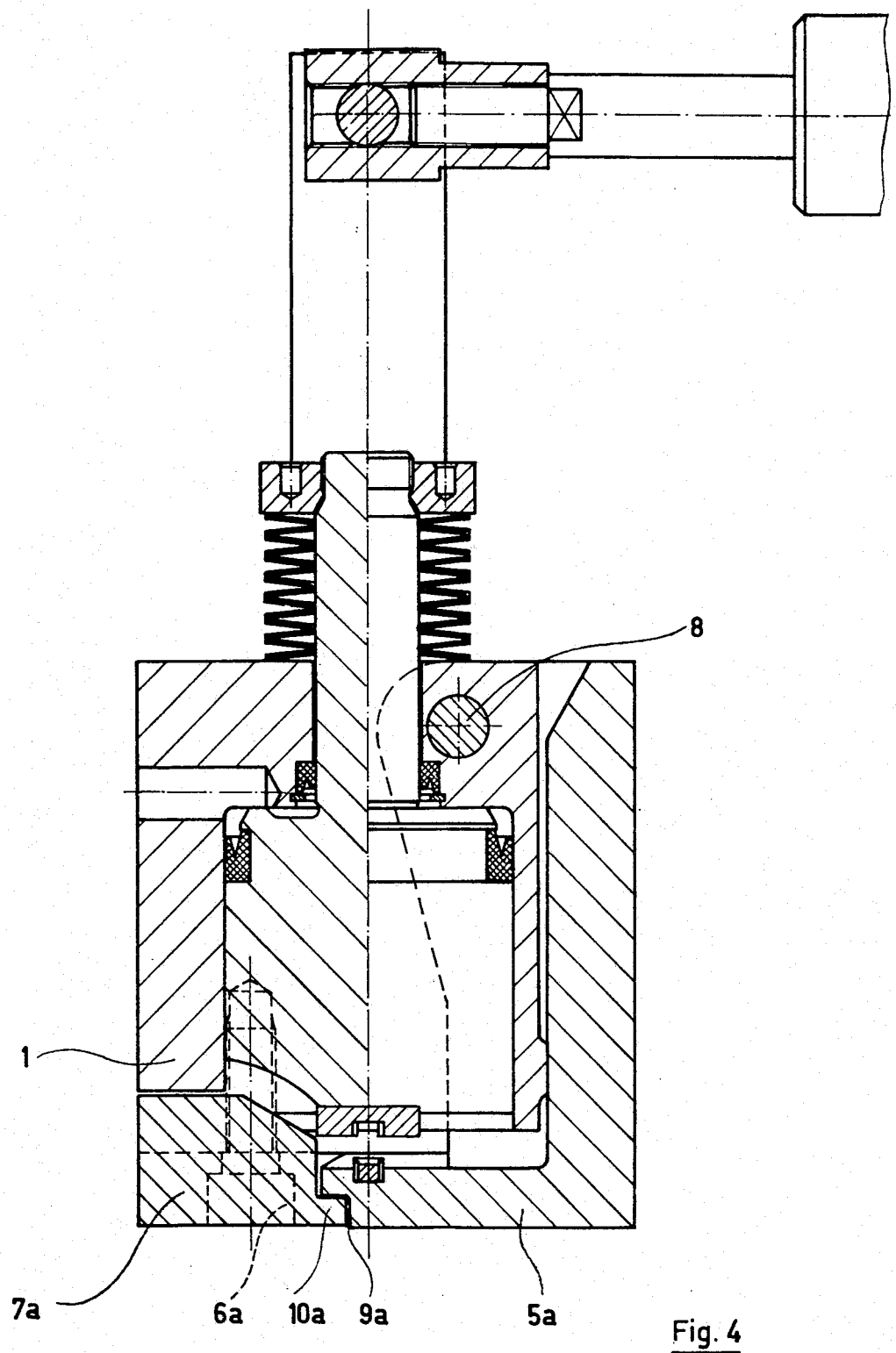
FIG. 4 illustrates a second embodiment of apparatus, similar to the showing of FIG. 1, wherein however the housing is articulated with the base plate member.

The modified version of equipment illustrated in FIG. 4 basically constitutes a reversal of certain parts, namely illustrates an arrangement wherein here, in contrast to the embodiment of FIGS. 1 to 3, the housing is articulated or hingedly connected with the base plate member. Thus, it will be specifically seen that housing 1 is not pivotably connected with the counter-holder member 7*a*, rather with the base plate member 5*a*, which again possesses a recess 9*a*. The counter-holder member 7*a*, with this embodiment, is threadably attached by means of the screws 6*a* or equivalent fastening structure with the housing 1 and contains a nose 10*a*, which with the apparatus closed, engages into the recess 9*a* of the base plate member 5*a*. The mode of operation of this modified form of equipment corresponds in principle to the function of the apparatus of FIGS. 1 to 3. Upon opening of the device the band portions which have been interconnected with one another do not here slide off of the lower tool 4, rather remain seated thereon and the apparatus therefore must be laterally slid-out beneath the interconnected band portions.

The various embodiments of apparatus herein disclosed can be constructed to be portable and semi-automatic, and the pivoting function can either be accomplished by means of the illustrated piston-cylinder unit or equivalent structure or manually. It is also possible to incorporate the apparatus into a completely automatic strapping machine.

While there are shown and described present preferred embodiments of the invention, it is to be distinctly understood that the invention is not limited thereto, but may be otherwise variously embodied and practiced within the scope of the following claims.

ACCORDINGLY,

I claim:

1. An apparatus for interconnecting two overlapping band portions, comprising:

a housing;

a first tool movably mounted at said housing;

drive means for driving said first tool;

a base plate member;

a second tool arranged to rest upon said base plate member;

a counter holder member;

means for fixedly connecting one of said members at the region of one side thereof with said housing;

means for releasably connecting the base plate member with the counter-holder member at a side of said one member opposite the side where said one member is rigidly connected with said housing; and means for pivotably connecting the other of said members with said housing to enable said counter-holder member and base plate member to be brought into and out of engagement with one another.

2. The apparatus as defined in claim 1, wherein:

said pivotably connecting means articulates the housing with the counter-holder member.

3. The apparatus as defined in claim 1, wherein:

said pivotably connecting means articulates the housing with the base plate member.

4. An apparatus for interconnecting two overlapping band portions, comprising:

a housing;

a first tool movably mounted at said housing;

drive means for driving said first tool;

a base plate member;

a second tool supported by said base plate member;

a counter holder member;

means for fixedly connecting one of said members at one location thereof with said housing;

means for releasably connecting the base plate member with the counter-holder member at a location spaced from the location where said one member is rigidly connected with said housing; and means for pivotably connecting the other of said members with said housing to enable said counter-holder member and base plate member to be brought into and out of engagement with one another.

5. The apparatus as defined in claim 1, wherein:

said members include form-locking means for interengaging said members when pivoted into engagement with one another.

6. The apparatus as defined in claim 6, wherein:

said form-locking means comprise a recess on one of said members and a nose element on the other of said members.

* * * * *